US005392019A

United States Patent [19]

Ohkubo

[11] Patent Number: 5,392,019

[45] Date of Patent: Feb. 21, 1995

[54] INDUCTANCE DEVICE AND MANUFACTURING PROCESS THEREOF

[75] Inventor: Akira Ohkubo, Nagaokakyo, Japan

[73] Assignee: Murata Manufacturing Co., Ltd., Nagaokakyo, Japan

[21] Appl. No.: 980,735

[22] Filed: Nov. 24, 1992

[30] Foreign Application Priority Data

Nov. 28, 1991 [JP] Japan ..... 3-314151

[51] Int. Cl.[6] ..... H01F 5/02

[52] U.S. Cl. ..... 336/200

[58] Field of Search ..... 336/200, 232

[56] References Cited

U.S. PATENT DOCUMENTS

| | | | |
|---|---|---|---|
| 2,832,935 | 4/1958 | Tank | 336/200 X |
| 4,342,143 | 8/1982 | Jennings | 336/200 X |
| 4,641,114 | 2/1987 | Person | 336/200 X |
| 4,942,373 | 7/1990 | Ozawa et al. | 336/200 X |
| 5,035,710 | 7/1991 | Kawaguchi | 336/200 X |
| 5,051,712 | 9/1991 | Naito et al. | 336/200 X |
| 5,250,923 | 10/1993 | Ushiro et al. | 336/200 X |

FOREIGN PATENT DOCUMENTS

| | | | |
|---|---|---|---|
| 4329607 | 11/1992 | Japan | 336/200 |

*Primary Examiner*—Leo P. Picard
*Assistant Examiner*—L. Thomas
*Attorney, Agent, or Firm*—Burns, Doane, Swecker & Mathis

[57] ABSTRACT

An inductance device which has a structure wherein insulating layers and coil conductors are alternately laminated and the coil conductors are electrically connected with one another. For example, insulating sheets each of which has a coil conductor thereon and insulating sheets each of which has a guard electrode thereon are alternately laminated. In the laminate state, the coil conductors are serially connected by through holes made in the insulating sheets, and thus a coil is formed. There is provided a guard electrode between two adjacent coil conductors, and the guard electrode electrically shields the coil conductors from each other.

6 Claims, 3 Drawing Sheets

INDUCTANCE DEVICE AND MANUFACTURING PROCESS THEREOF

BACKGROUND OF THE INVENTION

1. Field of the Invention

The present invention relates to an inductance device to be installed in a high-frequency electronic appliance or the like, and a manufacturing process of the inductance device.

2. Description of Related Art

A conventional type of inductance device has a structure wherein insulating sheets which have coil conductors thereon are laminated and the coil conductors are electrically connected with one another by through holes made in the insulating sheets. This type of inductance device has a disadvantage that large stray capacities occur among the coil conductors because of the thinness of the insulating sheets. The more coil conductors, the larger the total of stray capacities among the coil conductors. Therefore, if the inductance device is installed in a high-frequency electronic appliance to be used as a noise filter, the self-resonance frequency of the coil is lowered, and the noise elimination performance in a high frequency range is degraded.

SUMMARY OF THE INVENTION

An object of the present invention is to provide an inductance device which has merely small stray capacities among its coil conductors.

In order to attain the object, an inductance device according to the present invention has a guard electrode between coil conductors. By grounding the guard electrode, the adjacent coil conductors with the guard electrode in between are electrically shielded from each other. Thereby, a stray capacity does not occur between the coil conductors.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Some exemplary inductance devices according to the present invention are hereinafter described.

Figure 1:
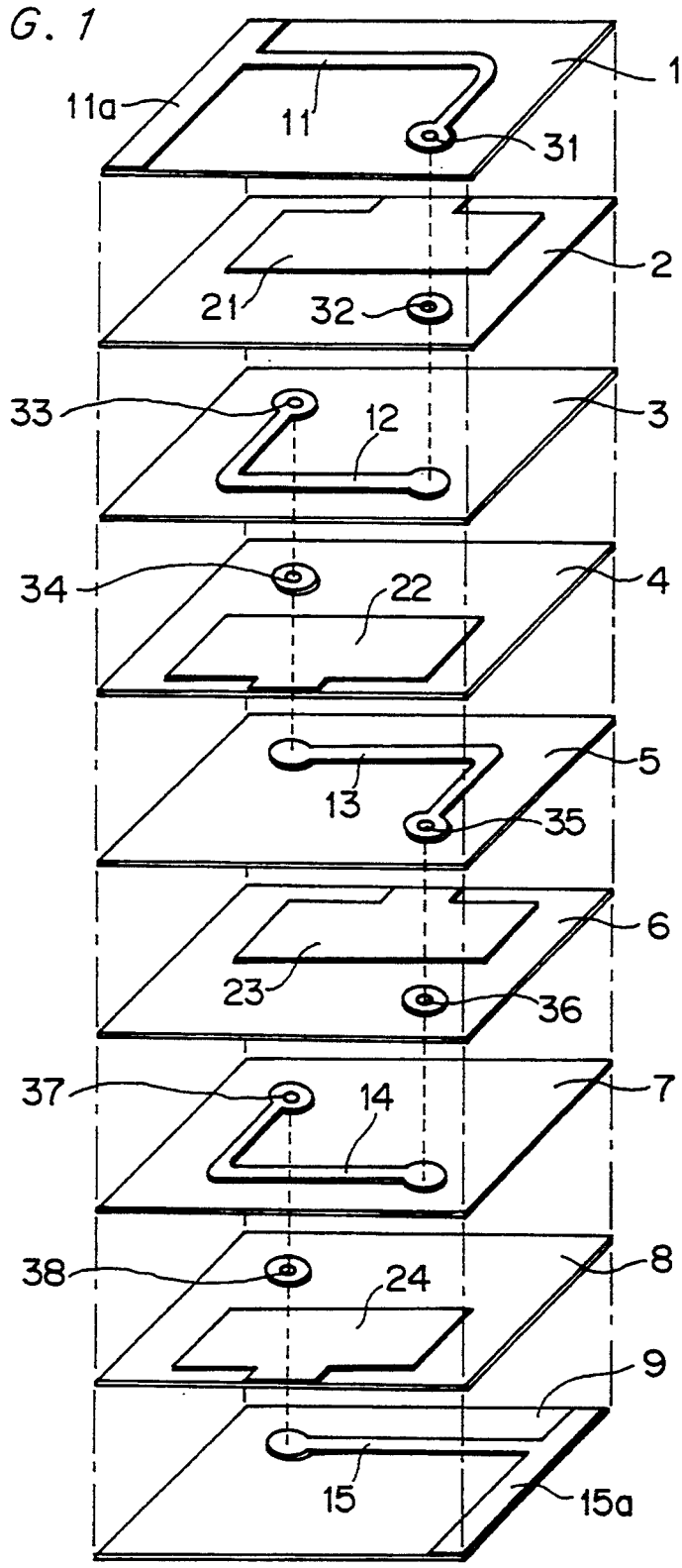
FIG. 1 is an exploded plan view of an inductance device which is a first embodiment of the present invention.
Figure 2:
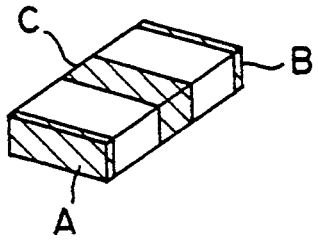
FIG. 2 is a perspective view of the inductance device.
Figure 3:
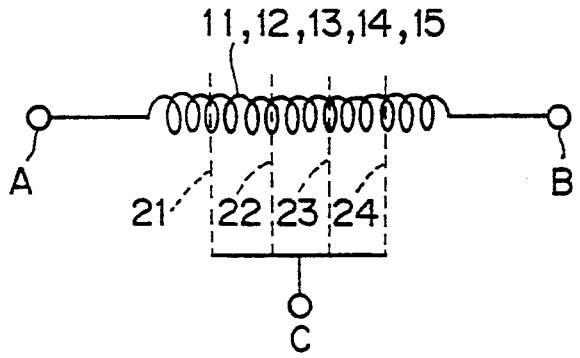
FIG. 3 is a diagram showing tile equivalent electric circuit of the inductance device.

First Embodiment: FIGS. 1–3

Referring to FIG. 1, an inductance device of a first embodiment has a coil which comprises nine insulating sheets 1, 2, 3, 4, 5, 6, 7, 8 and 9, coil conductors 11, 12, 13, 14 and 15 provided on upper surfaces of tile insulating sheets 1, 3, 5, 7 and 9 respectively, and guard electrodes 21, 22, 23 and 24 provided on upper surfaces of the insulating sheets 2, 4, 6 and 8 respectively. The insulating sheets 1 through 9 are made of a magnetic material such as Ferrite. Copper or silver is used as the material of the coil conductors 11 through 15 and tile guard electrodes 21 through 24, and they are formed by coating and printing paste of the material on the insulating sheets 1 through 9.

The insulating sheets 1 through 9 are laminated such that the sheets are arranged in order of number from the top. In the laminate state, an end of the coil conductor 11 is electrically connected with an end of the coil conductor 12 by through holes 31 and 32 made in the insulating sheets 1 and 2 respectively. Likewise, the other end of the coil conductor 12 is electrically connected with an end of a coil conductor 13 by through holes 33 and 34 made in the insulating sheets 3 and 4 respectively. The other end of the coil conductor 13 is electrically connected with an end of a coil conductor 14 by through holes 35 and 36 made in the insulating sheets 5 and 6 respectively. The other end of the coil conductor 14 is electrically connected with an end of a coil conductor 15 by through holes 37 and 38 made in the insulating sheets 7 and 8 respectively. In this way, the coil conductors 11 through 15 are serially connected with one another by the through holes 31 through 38, and thus a coil is formed.

In the laminate structure, the guard electrode 21 is between the conductors 11 and 13 and is insulated from the conductors 11 and 13 by the insulating sheets 1, 2, 3 and 4. The guard electrode 21 electrically shields the conductors 11 and 13 from each other. Likewise, tile guard electrode 22 is between the conductors 12 and 14 and is insulated from the conductors 12 and 14 by the insulating sheets 3, 4, 5 and 6. The guard electrode electrically shields the conductors 12 and 14 from each other. The guard electrode 23 is between the conductors 13 and 15 and is insulated from the conductors 13 and 15 by the insulating sheets 5, 6, 7 and 8. The guard electrode 23 electrically shields the conductors 13 and 15 from each other. The guard electrode 24 electrically shields the conductor 14 from an external electromagnetic field.

After laminating the insulating sheets 1 through 9, insulating protection sheets are further laid on the upper surface and the lower surface of the laminate. FIG. 2 shows a finished inductance device. An input electrode A is provided at one side of the inductance device, and an output electrode B is provided at the other side. A grounding electrode C is provided in the center. The electrode A is electrically connected with a leading portion 11*a* of the coil conductor 11, and the electrode B is electrically connected with a leading portion 15a of the coil conductor 15. The electrode C is electrically connected with the guard electrodes 21 through 24. FIG. 3 shows the equivalent electric circuit of the inductance device.

When the grounding electrode C is grounded, the guard electrodes 21 through 24 are grounded. The guard electrodes 21 through 24 electrically shield tile coil conductors 11 and 13 from each other, tile coil conductors 12 and 14 from each other and the coil conductors 13 and 15 from each other, thereby reducing the stray capacities between the conductors 11 and 13, between the conductors 12 and 14 and between the conductors 13 and 15.

Since the inductance device has a coil with a high self-resonance frequency, if the inductance device is installed in a high-frequency electronic appliance to be used as a noise filter, it can achieve a great noise elimination performance.

Figure 5:
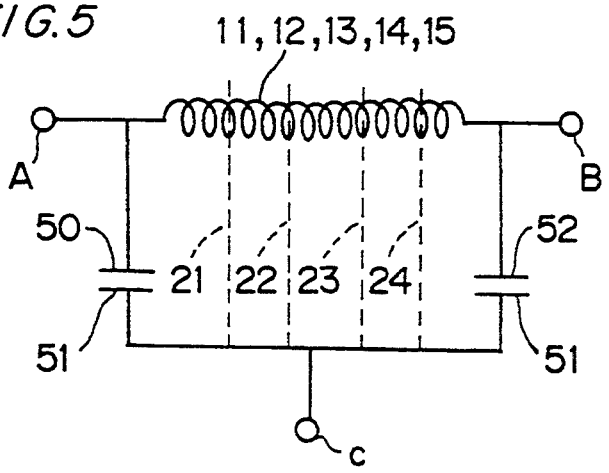
FIG. 5 is a diagram showing tile equivalent electric circuit of the inductance device of the second embodiment.
Figure 4:
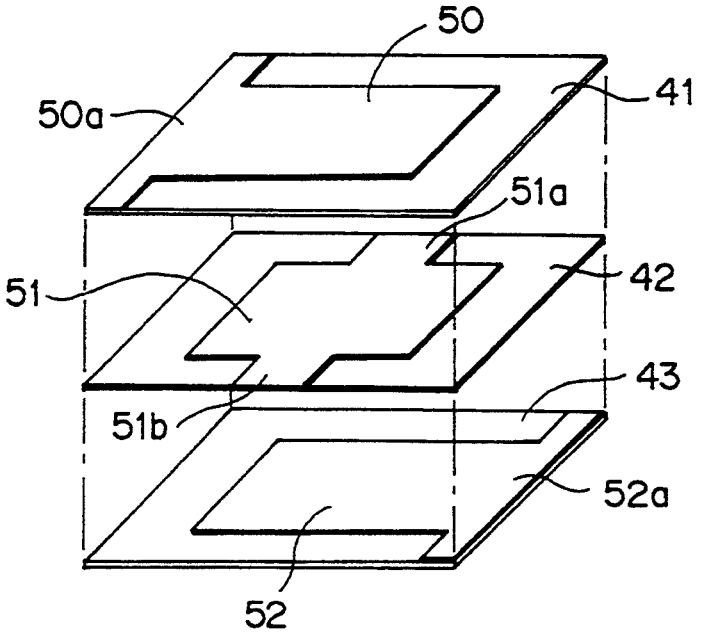
FIG. 4 is an exploded plan view of a capacitor incorporated in an inductance device which is a second embodiment of the present invention.

Second Embodiment: FIGS. 4 and 5

An inductance device of a second embodiment has a built-in capacitor. FIG. 4 shows tile capacitor of the inductance device. The capacitor comprises three insulating sheets 41, 42 and 43, and capacitor electrodes 50, 51 and 52 provided on tile sheets 41, 42 and 43 respectively. The insulating sheets 41 through 43 are made of a dielectric material. Copper or silver is used as the material of the capacitor electrodes 50 through 52, and the electrodes 50 through 52 are formed by coating and printing paste of the material on the insulating sheets 41 through 43.

The inductance device has a coil which has the structure described in connection with the first embodiment. More specifically, the coil comprises the insulating sheets 1 through 9, the coil conductors 11 through 15, and the guard electrodes 21 through 24.

The insulating sheets 1 through 9 are laminated such that the sheets are arranged in order of number from the top, and an insulating dummy sheet is laid on the lower surface of the laminate. Further, under the insulating dummy sheet, the insulating sheets 41 through 43 are laminated in order of number. Then, insulating protection sheets are laid on the upper surface and the lower surface of the laminate of the insulating sheets 1 through 9 and 41 through 43, and thus an inductance device is finished. FIG. 5 shows the equivalent electric circuit of the inductance device. An input electrode A is provided at one side of the inductance device, and an output electrode B is provided at the other side. A grounding electrode C is provided in the center. The electrode A is electrically connected with the leading portion 11*a* of the coil conductor 11 and with a leading portion 50*a* of the capacitor electrode 50. The electrode B is electrically connected with the leading portion 15*a* of the coil conductor 15 and with a leading portion 52*a* of the capacitor electrode 52. The electrode C is electrically connected with the guard electrodes 21 through 24 and with leading portions 51*a* and 51*b* of the capacitor electrode 51.

When the grounding electrode C is grounded, the guard electrodes 21 through 24 operate in the same way as described in connection with the first embodiment. Consequently, the inductance device with a built-in capacitor can be used as an oscillator which has a great frequency characteristic in a high frequency range.

Other Embodiments

Although the present invention has been described in connection with the preferred embodiments above, it is to be noted that various changes and modifications are possible to those who are skilled in the art. Such changes and modifications are to be understood as being within the scope of the invention.

It is not always necessary that a guard electrode is provided between any two adjacent coil conductors. Guard electrodes may be provided only at necessary places. It is also possible to provide a plurality of insulating sheets each of which has a guard electrode thereon between two adjacent coil conductors.

Figure 6:
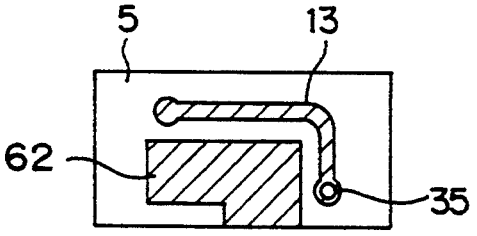
FIG. 6 is a plan view of a modified guard electrode.

FIG. 6 shows a modified guard electrode 62 which has the same function as the guard electrode 23 formed on the insulating sheet 6. The guard electrode 62 is formed on the insulating sheet 5 together with the coil conductor 13.

As the material of the insulating sheets, not only a magnetic material such as ferrite but also ceramics, resin or the like can be used.

In the embodiments above, through holes are used for electrical connections among the coil conductors. However, the electrical connections may be achieved in other ways without using the through holes. Further, the coil conductors can be so made that the coil conductors will form a spiral coil.

In the above-described embodiments, an inductance device is produced by laminating insulating sheets which have coil conductors and insulating sheets which have guard electrodes. It is also possible to laminate an insulating material, the material of coil conductors and the material of guard electrodes by printing paste of these materials in order. In this case, through holes cannot be used for electrical connections among the coil conductors. In order to achieve the electrical connections, the insulating material is printed on the coil conductors such that a portion of each conductor is not coated with the insulating material and that the uncoated portions of adjacent conductors can be in contact with each other directly.

What is claimed is:

1. An inductance device comprising:

a plurality of rectangular insulating sheets which are made of ceramic;

a plurality of coil conductors which are electrically connected with each other via electrical connecting means provided on the insulating sheets to form a loop coil; and at least one rectangular guard electrode;

wherein:

the insulating sheets, the coil conductors and the at least one guard electrode are laminated to form a rectangular laminate in which each of the coil conductors and the guard electrode is between two insulating sheets, and the guard electrode covers parts of two mutually adjacent coil conductors to electrically shield the conductors partly;

two leading portions of the loop coil being exposed on first and second mutually opposite sides of the rectangular laminate; and a leading portion of the guard electrode being exposed on a third side of the rectangular laminate.

2. An inductance device as claimed in claim 1, wherein the coil conductors are electrically connected with each other by through holes.

3. An inductance device as claimed in claim 1, further comprising a capacitor comprising capacitor electrodes and a dielectric sheet.

4. Apparatus formed as a laminate structure comprising:

a first insulating sheet formed with a first coil conductor and a first conductive contact;

a second insulating sheet formed with a second coil conductor and a second conductive through-hole contact, said second conductor being adjacent to and in alignment with said first conductor;

a third insulating sheet located between said first and second insulating sheets, said third insulating sheet being formed with a guard electrode insulated from said first and second conductors by said second and third insulating sheets and being formed with a third conductive through-hole contact connected to said second conductive through-hole contact for interconnecting said first and second coil conductors, said guard electrode electrically shielding a first portion of said first coil conductor from said second coil conductor, while leaving a second portion of said first conductor unshielded from said second coil conductor, wherein said first conductive contact is not aligned with said second and third conductive through-hole contacts.

5. Apparatus according to claim 4, wherein said first, second and third insulating sheets are formed of ceramic.

6. Apparatus according to claim 4 further comprising:

a fourth insulating sheet located between said first and second insulating sheets, said fourth insulating sheet being formed with a second guard electrode insulated from said first and second conductors, said second guard electrode electrically shielding said second portion of said first coil conductor from said second coil conductor.

* * * * *